US005089855A

United States Patent [19]

Mochimaru

[11] Patent Number: 5,089,855

[45] Date of Patent: Feb. 18, 1992

[54] IMAGE FORMING APPARATUS WHICH FORMS IMAGE BY ELECTROPHOTOGRAPHY

[75] Inventor: Hideaki Mochimaru, Yokohama, Japan

[73] Assignee: Ricoh Company, Ltd., Tokyo, Japan

[21] Appl. No.: 714,658

[22] Filed: Jun. 13, 1991

[30] Foreign Application Priority Data

Jun. 20, 1990 [JP] Japan ..... 2-161547
Oct. 16, 1990 [JP] Japan ..... 2-277115
Apr. 12, 1991 [JP] Japan ..... 3-108564

[51] Int. Cl.[5] ..... G03G 15/14
[52] U.S. Cl. ..... 355/271; 355/315
[58] Field of Search ..... 355/212, 271, 277, 315, 355/274, 279, 278

[56] References Cited

U.S. PATENT DOCUMENTS 4,062,631 12/1977 Ichikawa et al. ..... 355/315
4,068,937 1/1978 Willemse et al. ..... 355/212
4,531,825 7/1985 Miwa et al. ..... 355/279

FOREIGN PATENT DOCUMENTS 316774 12/1989 Japan .

*Primary Examiner*—A. T. Grimley
*Assistant Examiner*—Patrick J. Stanzione
*Attorney, Agent, or Firm*—Cooper & Dunham

[57] ABSTRACT

An image forming apparatus includes support rollers, a photosensitive belt which is fit around the support rollers to form an endless loop, a unit for forming an electrostatic image on an outer surface of the photosensitive belt, a unit for developing the electrostatic image into a toner image, a transfer roller which is located outside the endless loop of the photosensitive belt and by itself makes contact with the outer surface of the photosensitive belt for a first angular range and bends the photosensitive belt towards the inner side of the endless loop, a mechanism for supplying a recording medium between the photosensitive belt and the transfer roller so that the transfer roller transfers the toner image onto the recording medium, and a receiving roller which is located inside the endless loop of the photosensitive belt. The receiving roller makes contact with the inner surface of the photosensitive belt so that the transfer roller makes contact with the outer surface of the photosensitive belt for a second angular range which is greater than the first angular range through cooperation of the transfer roller and the receiving roller.

14 Claims, 6 Drawing Sheets

IMAGE FORMING APPARATUS WHICH FORMS IMAGE BY ELECTROPHOTOGRAPHY

BACKGROUND OF THE INVENTION

The present invention generally relates to image forming apparatuses, and more particularly to an image forming apparatus which forms an image on a recording medium by electrophotography. The present invention is suited for application to a printer, a copying machine and a facsimile machine which use a laser beam to print the image on the recording medium such as a sheet of paper and an envelope.

Conventionally, in an image forming apparatus of the electrophotography type, a photoconductive or photosensitive body 1 in the form of an endless belt is provided across a driving roller 2 and a roller 3 as shown in FIG.1. The photosensitive body 1 is driven by rotating the driving roller 2, and a charger 4 uniformly charges the surface of the photosensitive body 1. A write part 5 irradiates a laser beam on the charged surface of the photosensitive body 1 to form an electrostatic image, and this electrostatic image is developed by a developer unit 6 which visualizes the electrostatic image into a toner image. A transfer charger 7 transfers the toner image onto a recording medium such as a sheet of paper. Such an image forming apparatus is proposed in a Japanese Laid-Open Utility Model Application No.61-193477, for example.

On the other hand, a Japanese Laid-Open Patent Application No.1-316774 proposes a structure shown in FIG.2. In FIG.2, the transfer roller 9 presses against the photosensitive body 8 which has a drum shape, and the recording medium is inserted and pinched between the transfer roller 9 and the photosensitive body 8 when printing the image on the recording medium. A voltage is applied to the transfer roller 9 when the recording medium is inserted so that the toner image on the surface of the photosensitive body 8 is transferred onto the recording medium, similarly as in the case of the image forming apparatus shown in FIG.1.

However, in the conventional image forming apparatuses described above, problems occur when the recording medium is a thin paper which is weak, that is, has a poor rigidity, along the direction in which the paper is transported within the image forming apparatus. In other words, the paper may curl around photosensitive body 8 or the transfer roller 9 after the toner image is transferred onto the paper instead of being separated from the photosensitive body 8 or the transfer roller 9 to be ejected.

In addition, because the recording medium tends to curl around the photosensitive body 8 and the transfer roller 9 becomes deformed with time after recording mediums of various sizes and thicknesses are inserted between the photosensitive body 8 and the transfer roller 9, the pinching force exerted by the photosensitive body and the transfer roller 9 on the recording medium becomes unstable. For this reason, there is a problem in that the transfer of the toner image onto the recording medium becomes non-uniform, thereby resulting in a poor picture quality of the formed image.

SUMMARY OF THE INVENTION

Accordingly, it is a general object of the present invention to provide a novel and useful image forming apparatus in which the problems described above are eliminated.

Another and more specific object of the present invention is to provide an image forming apparatus which forms an image on a recording medium by electrophotography during a print operation, comprising a plurality of support rollers including at least one drive roller, a photosensitive belt which is fit around the support rollers to form an endless loop, where the photosensitive belt has a photosensitive outer surface and an inner surface which is driven by the drive roller so that the photosensitive belt circulates in one direction, first means for forming an electrostatic image on the outer surface of the photosensitive belt, second means for developing the electrostatic image on the outer surface of the photosensitive belt into a toner image, a transfer roller which is located outside the endless loop of the photosensitive belt, where the transfer roller alone makes contact with the outer surface of the photosensitive belt for a first angular range and bending the photosensitive belt towards the inner side of the endless loop, third means for supplying a recording medium between the photosensitive belt and the transfer roller so that the transfer roller transfers the toner image on the outer surface of the photosensitive belt onto the recording medium, and a receiving roller which is located inside the endless loop of the photosensitive belt, the receiving roller making contact with the inner surface of the photosensitive belt so that the transfer roller makes contact with the outer surface of the photosensitive belt for a second angular range which is greater than the first angular range through cooperation of the transfer roller and the receiving roller. According to the image forming apparatus of the present invention, it is possible to prevent the recording medium from curling around the photosensitive belt after the transfer of the toner image because the recording medium is transported along the transfer roller and the photosensitive belt which has the form of an endless loop which is locally bent. In addition, a stable image formation is ensured because the transfer roller pushes against the photosensitive belt. The image formation is further stabilized by the provision of the receiving roller which confronts the transfer roller.

Still another object of the present invention is to provide an image forming apparatus of the above described type which further comprises fourth means for urging the transfer roller against the outer surface of the photosensitive belt only during the print operation. According to the image forming apparatus of the present invention, it is possible to reduce the stress on the photosensitive belt because the transfer roller does not push against the photosensitive belt when no print operation is carried out. In addition, it is possible to extend the serviceable life of the photosensitive belt and prevent the peripheral surface of the transfer roller from becoming deformed with age.

Other objects and further features of the present invention will be apparent from the following detailed description when read in conjunction with the accompanying drawings.

DESCRIPTION OF THE PREFERRED EMBODIMENTS

Figure 1:
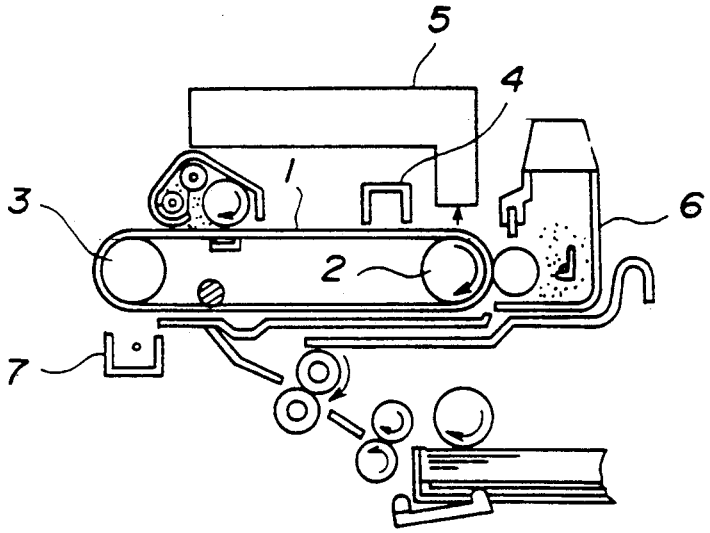
FIG. 1 PRIOR ART
FIG.1 is a cross sectional view showing an essential part of an example of a conventional image forming apparatus.
Figure 2:
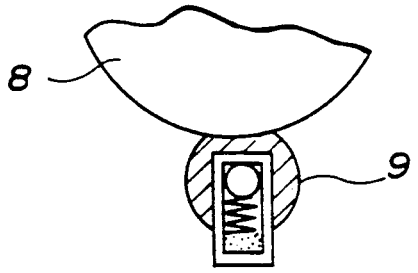
FIG. 2 PRIOR ART
FIG. 2 is a cross sectional view showing an essential part of another example of a conventional image forming apparatus.
Figure 3:
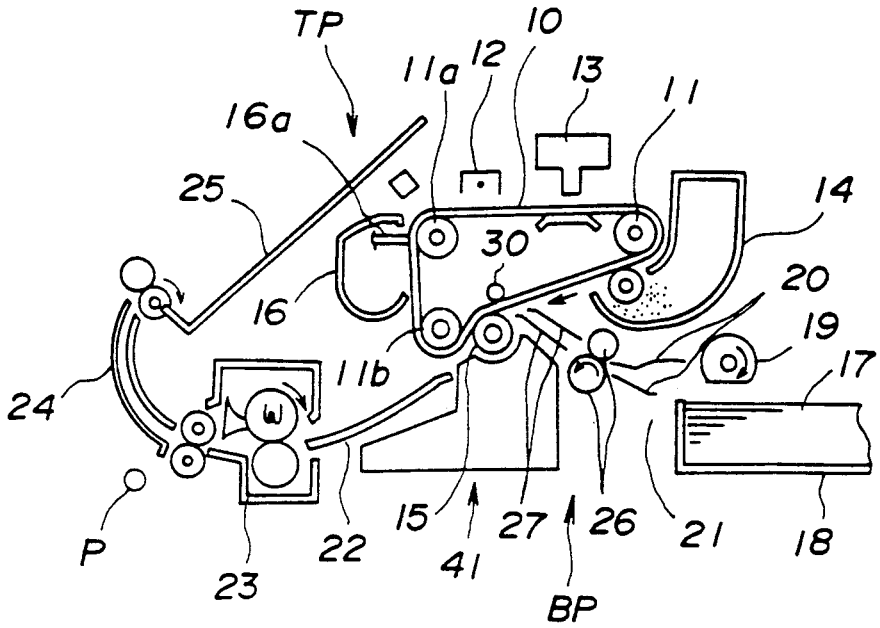
FIG. 3 is a cross sectional view showing an essential part of a first embodiment of an image forming apparatus according to the present invention.

FIG.3 generally shows internal mechanisms of a first embodiment of an image forming apparatus according to the present invention. In this embodiment, the present invention is applied to a laser printer.

A photosensitive belt 10 is fit around a drive roller 11 and rollers 11*a* and 11*b* at a central part within a main printer body in the form of an endless belt. This photosensitive belt 10 circulates clockwise. A charger 12, a laser optical system 13, a developer unit 14, a transfer roller 15 and a cleaning unit 16 are provided around the photosensitive belt 10 in the clockwise sequence. A paper tray 18 is detachably provided on the right part of the main printer body, and recording sheets 17 are accommodated within the paper tray 18. A paper supply part 21 is provided at the part of the main printer body where the paper tray 18 is provided. This paper supply part 21 includes a paper supply roller 19 and a paper guide plate 20.

A transport guide 22, a fixing unit 23 and a paper eject path 24 are sequentially arranged on the left part of the main printer body. In addition, an eject tray 25 is provided on the top left part of the main printer body for receiving the ejected recording sheets 17. The main printer body can be opened about a point P, whereby the main printer body is separated into top and bottom body parts TP and BP.

When this laser printer is used to print an image on the recording sheet 17 by the electrophotography method, a known control unit (not shown) of the laser printer drives the paper supply roller 19 so as to supply the recording sheet 17 from the paper supply tray 18. The control unit controls the sequential operation of the entire laser printer, and a description thereof will be omitted in this specification. The recording sheet 17 supplied from the paper supply tray 18 is guided by the paper guide plate 20 and is transported until the tip end of the recording sheet 17 hits resist rollers 26. The tip end of the recording sheet 17 can be detected by a known means such as a sensor, and the control unit can stop the transport of the recording sheet 17 when the sensor detects the tip end of the recording sheet 17 at the resist rollers 26.

The photosensitive belt 10 is driven by rotating the drive roller 11 by the control unit. The photosensitive belt 10 circulates clockwise in FIG.3, and the surface of the photosensitive belt 10 is uniformly charged by the charger 12. Then, the laser optical system 13 forms an electrostatic image on the charged surface of the photosensitive belt 10 by irradiating a laser beam on the charged surface depending on the image which is to be formed on the recording sheet 17. The electrostatic image on the photosensitive belt 10 is successively visualized into a toner image by the developer unit 14. The control unit thereafter carries out a known control so that the recording sheet 17 is fed from the resist rollers 26 toward the photosensitive belt 10 under the guidance of the guide plate 27 with a timing which is matched to the toner image. As a result, the toner image on the photosensitive belt 10 is transferred onto the recording sheet 17 by the transfer roller 15. The toner remaining on the surface of the photosensitive belt 10 is removed by a cleaning blade 16*a* of the cleaning unit 16 so as to clean and prepare the surface of the photosensitive belt 10 for the next print operation.

After the image is formed on the recording sheet 17, this image is fixed by the fixing unit 23 which applies heat and pressure on the recording sheet 17. This recording sheet 17 is then ejected via the eject path 24, and the recording sheets 17 which are ejected in this manner are stacked on the eject tray 25.

In this embodiment, the transfer roller 15 pushes against the surface of the photosensitive belt 10 from the outer side so that the photosensitive belt 10 bends along the surface of the transfer roller 15. In addition, a receiving roller 30 is provided on the inside of the photosensitive belt 10 for receiving the photosensitive belt 10 which is pushed by the transfer roller 15. The receiving roller 30 is arranged in a vicinity of the transfer roller 15 and guides the photosensitive belt 10 so as to increase an angular range in which the photosensitive belt 10 is wound around the transfer roller 15.

Figure 4:
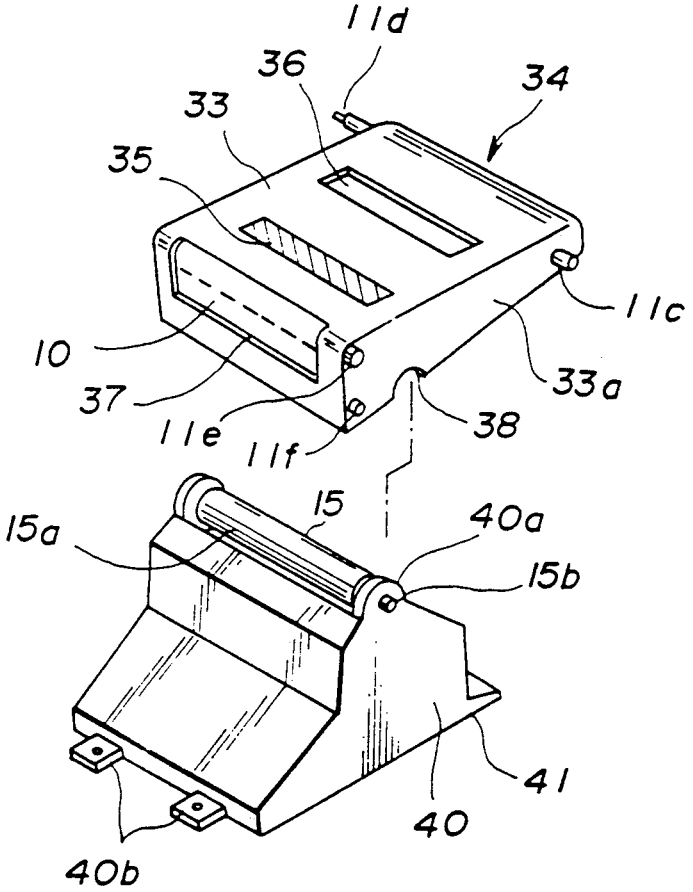
FIG. 4 is a perspective view showing a photosensitive body unit and a power source unit of the first embodiment in a disassembled state.

At least the photosensitive belt 10, the drive roller 11, the rollers 11*a* and 11*b*, and the receiving roller 30 are supported and accommodated within a casing 33 shown in FIG.4. The casing 33, the photosensitive belt 10, the drive roller 11, the rollers 11*a* and 11*b*, and the receiving roller 30 form a photosensitive body unit 34. The casing 33 includes a grid 35, a window 36 for passing the laser beam which irradiates the surface of the photosensitive belt 10, and a cleaning window 37 through which the cleaning blade 16*a* makes contact with the surface of the photosensitive belt !0.

Although not shown in FIG.4, the casing 33 is also provided with a developer roller window through which a developer roller of the developer unit 14 makes contact with the surface of the photosensitive belt 10, and a transfer roller window through which the transfer roller 15 makes contact with the surface of the photosensitive belt 10. In addition, a cutout 38 is provided in a lower edge of each side wall 33*a* of the casing 33.

In FIG.4, 11*c* denotes a roller shaft of the drive roller 11, 11*d* denotes a tapered serration for transferring a driving force to the drive roller 11, and 11*e* and 11*f* respectively denote roller shafts of the rollers 11*a* and 11*b*.

On the other hand, the transfer roller 15 is made up of a metal core and a resilient layer 15*a* which is provided around the metal code. The resilient layer 15*a* is made of rubber, for example. The roller shaft 15*b* of the transfer roller 15 is rotatably supported by bearings 40*a* of a casing 40. The casing 40 accommodates a power source (not shown) and forms a power source unit 41 together with the power source and the transfer roller 15. Mounting parts 40*b* are provided on the lower end of the casing 40. The transfer roller 15 is electrically coupled to the power source which is accommodated within the casing 40.

The power source unit 41 is fixed within the main printer body as shown in FIG.3, and the photosensitive body unit 34 is positioned by engaging the cutouts 38 to the bearings 40*a* of the casing 40. By this engagement, the transfer roller 15 pushes the surface of the photosensitive belt 10 from the outside, and the photosensitive belt 10 is bent towards the inside of the loop which is formed of the photosensitive belt 10. The bent photosensitive belt 10 is received by the receiving roller 30 which increases the angular range in which the photosensitive belt is wound around the transfer roller 15.

When carrying out a print operation, the drive roller 11 is rotated to drive the photosensitive belt 10, and the recording sheet 17 is transported in a state pinched between the photosensitive belt 10 and the transfer roller 15. After the electrostatic image on the surface of the photosensitive belt 10 is developed into the toner image, a voltage is applied to the transfer roller 15 from the power source so as to transfer the toner image onto the recording sheet 17. The recording sheet is thereafter transported along the transport roller 15 and the photosensitive belt 10 which is locally bent, and is separated from the photosensitive belt 10 after the toner image transfer.

Figure 5:
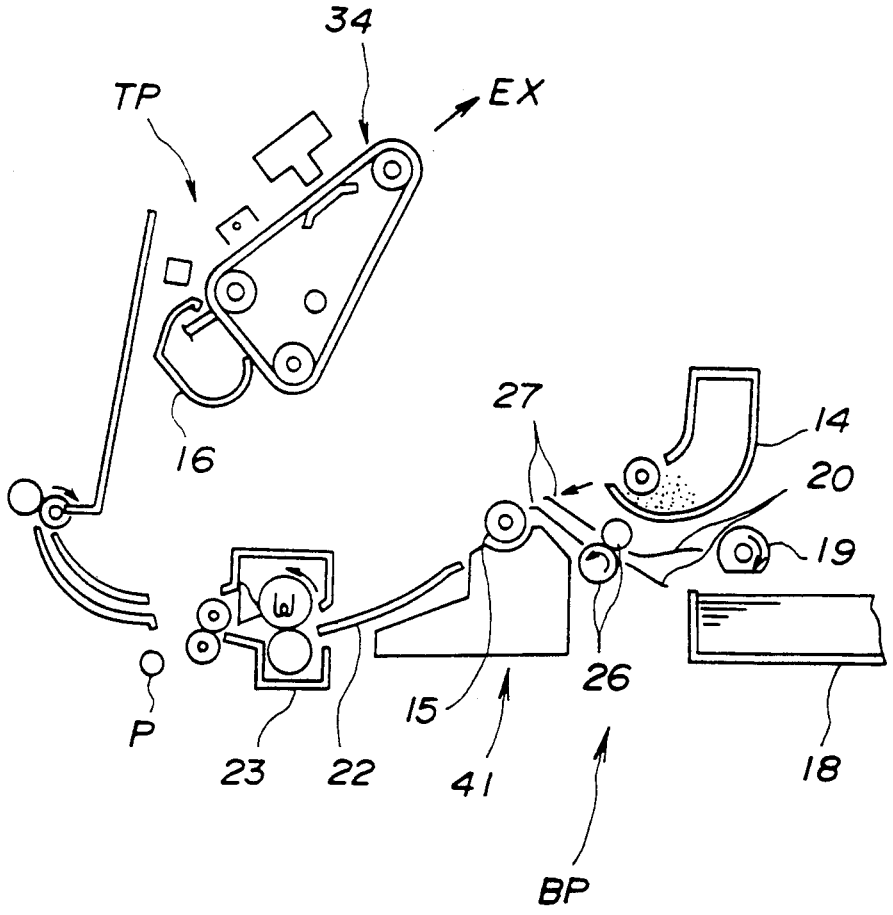
FIG. 5 is a cross sectional view showing internal mechanisms of the first embodiment when a printer body is opened.

When the serviceable life of the photosensitive body unit 34 ends, the top body part TP of the main printer body is opened about the point P as shown in FIG.5. The top body part TP supports at least the photosensitive body unit 34 and the cleaning unit 16. The remaining parts of the laser printer are supported by the bottom body part BP. The photosensitive body unit 34 is extracted removed in a direction EX from the open top body part TP, and is replaced by a new photosensitive body unit.

In this embodiment, the photosensitive body unit 34 is positioned by engaging the cutouts 38 to the bearings 40*a* of the power source unit 41, so that the transfer roller 15 pushes against the surface of the photosensitive belt 10. However, it is possible to urge at least one of the transfer roller 15 and the receiving roller 30 by an urging means such as a spring so that the transfer roller 15 and/or the receiving roller 30 pushes against the surface of the photosensitive belt 10.

Therefore, according to this embodiment, it is possible to prevent the recording medium from curling around the photosensitive body after the transfer of the toner image because the recording medium is transported along the transfer roller and the photosensitive body which has the form of an endless belt which is locally bent. In addition, a stable image formation is ensured because the transfer roller pushes against the photosensitive body. The image formation is further stabilized by the provision of the receiving roller which confronts the transfer roller. Furthermore, when the transfer roller is integrated on the power source unit, it becomes easier to mange and assemble the parts of the image forming apparatus on an assembly line, thereby improving the assembly efficiency. Moreover, the shielding of the contacts for applying the power source voltage can be made more positively when the transfer roller is integrated on the power source unit.

In the first embodiment, the transfer roller 15 constantly pushes against the surface of the photosensitive belt 10 from the outer side so as to bend the photosensitive belt 10 towards the inner side, regardless of whether or not the laser printer is carrying out the print operation. But in a second embodiment which will be described hereunder, measures are taken so that the transfer roller 15 pushes against the surface of the photosensitive belt 10 only during the print operation. In other words, the transfer roller 15 is released from the pushing state when the laser printer is not carrying out a print operation.

Figure 6:
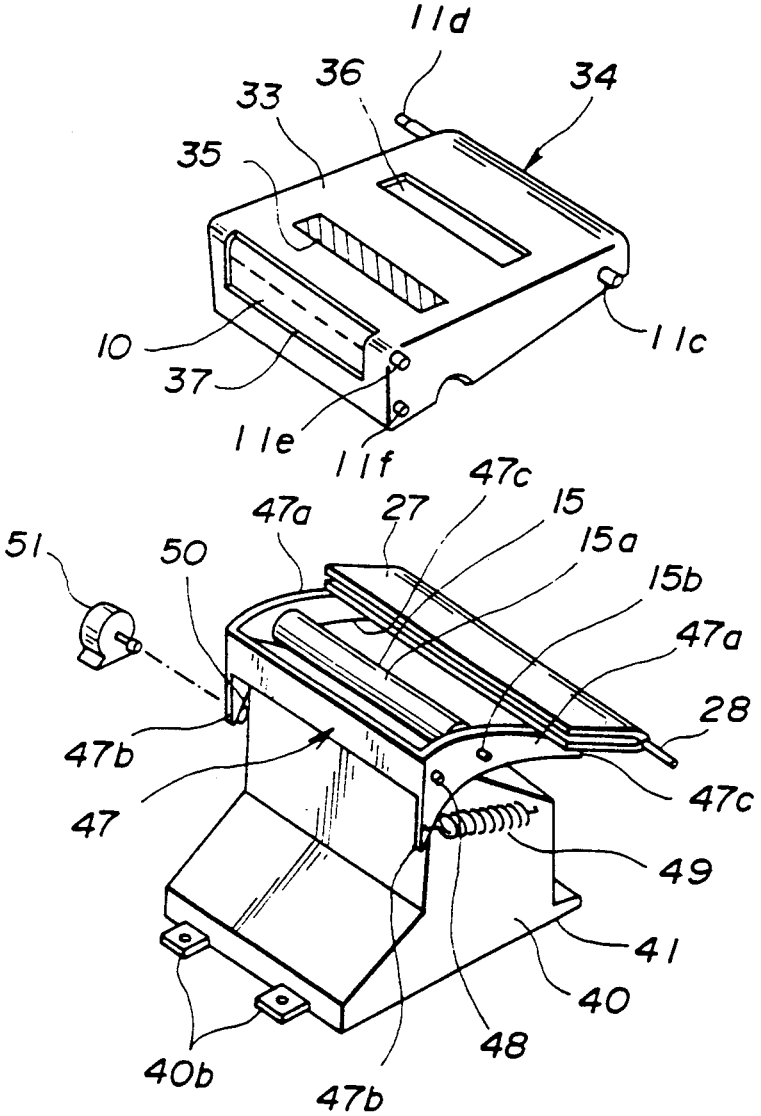
FIG. 6 is a perspective view showing a photosensitive body unit and a power source unit of a second embodiment of the image forming apparatus according to the present invention in a disassembled state.
Figure 7:
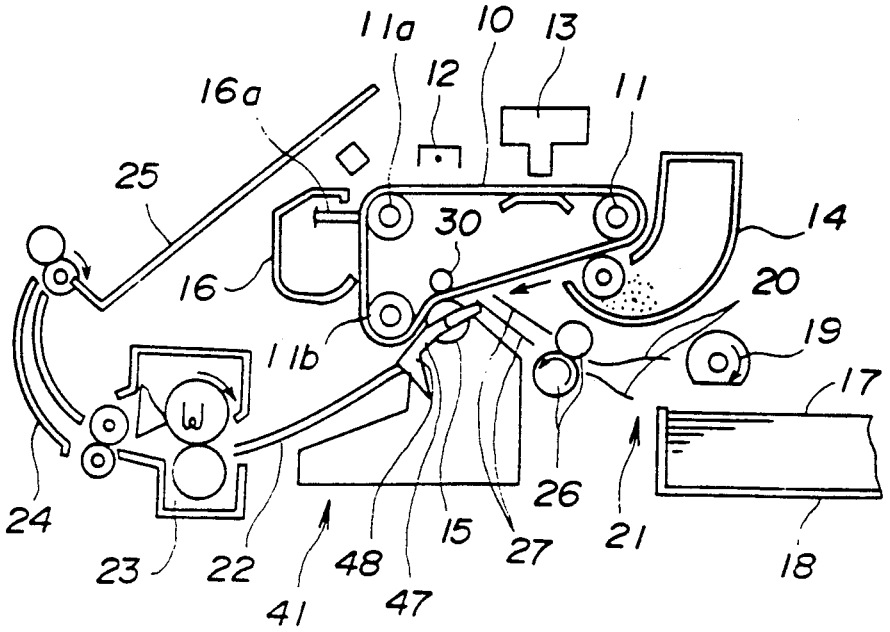
FIG.7 is a cross sectional view showing internal mechanisms of the second embodiment during a print operation.
Figure 8:
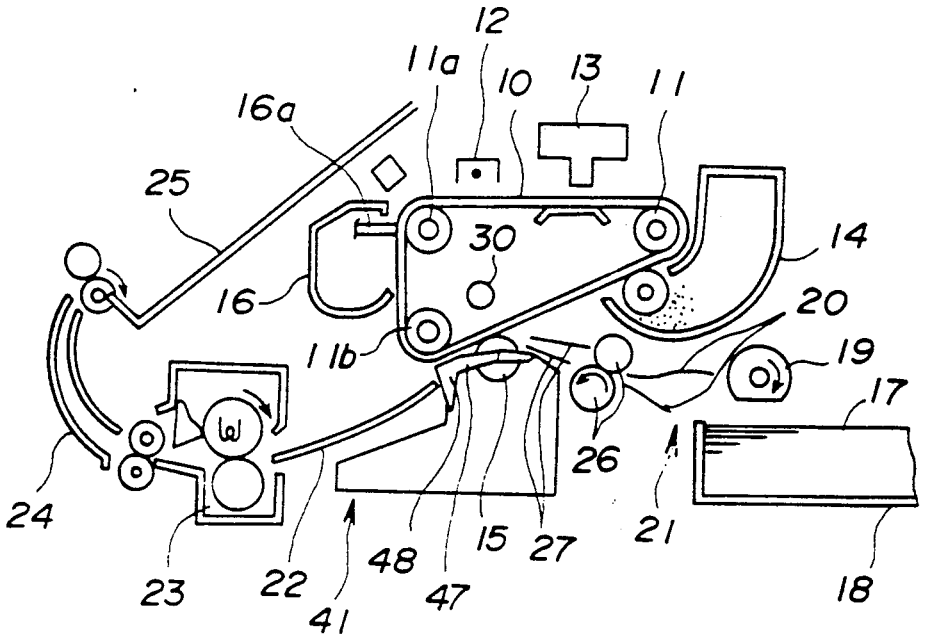
FIG. 8 is a cross sectional view showing the internal mechanisms of the second embodiment when no print operation is carried out.

The second embodiment will now be described with reference to FIGS. 6 through 8. In FIGS. 6 through 8, those parts which are the same as those corresponding parts in FIGS. 3 through 5 are designated by the same reference numerals, and a description thereof will be omitted.

As shown in FIGS. 6 through 8, a support member 47 supports the transfer roller 15 at the upper end part of the casing 40 in this second embodiment. The support member 47 includes a pair of arm parts 47*a* formed by bending a plate into a generally U-shape. A downwardly projecting part 47*b* is formed at the base end of each arm part 47*a*. The roller shaft 15*b* of the transfer roller 15 are rotatable supported by the arm parts 47*a*. A central part at the base end of the arm part 47*a* is rotatably supported by a pin 48 on each side of the casing 40.

One end of a coil spring 49 is fixed to one of the downwardly projecting part 47*b* of the support member 47. The other end of this coil spring 49 is fixed to the side of the casing 40 at a suitable position, so that the support member 47 is urged to rotate counterclockwise about the pin 48. An eccentric cam 50 makes contact with the inner side of the other downwardly projecting part 47*b* of the support member 47. A cam shaft of this eccentric cam 50 is connected to a driving means 51 such as a motor. This driving means 51 is turned ON/-OFF in response to a signal from the control unit indicating the start and end of the print operation. On the other hand, ends 47*c* of the arm parts 47*a* engage the lower side of the guide plate 27. The guide plate 27 is pivottable about a shaft 28 which is provided at a suitable position within the main printer body.

When carrying out the print operation, the support member 47 pivots counterclockwise about the pin 48 by the action of the coil spring 49, and the transfer roller 15 pushes against the surface of the photosensitive belt 10 from the outer side so as to bend the photosensitive belt 10 towards the inner side of the loop as shown in FIG.7. As a result, the receiving roller 30 pushes against the photosensitive belt 10 from the inner side and increases the angular range in which the photosensitive belt 10 is wound around the transfer roller 15. In addition, as the support member pivots counterclockwise, the guide plate 27 is pushed upwardly. For this reason, the tip end of the guide plate 27 moves closer to the photosensitive belt 10. The photosensitive belt 10 is driven by rotating the drive roller 11, and the recording sheet 17 is inserted between the photosensitive belt 10 and the transfer roller 15 under the guidance of the guide plate 27. The transfer of the toner image onto the recording sheet 17 is made similarly as in the first embodiment.

On the other hand, when no print operation is carried out, the control unit rotates the eccentric cam 50 by driving the drive means 51. In this case, the support member 47 pivots clockwise about the pin 48 against the force exerted by the coil spring 49. Hence, as shown in FIG.8, the transfer roller 15 is released from the pushing position and will not push against the surface of the photosensitive belt 10. At the same time, the tip end of the guide plate 27 moves away from the photosensitive belt 10 as the support member 47 pivots clockwise.

Figure 9:
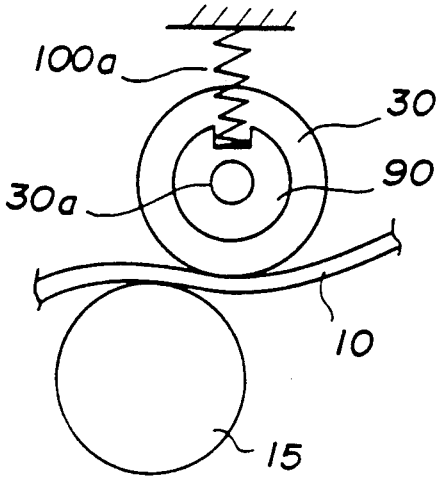
FIG. 9 is a cross sectional view showing a receiving roller which is equipped with an urging means.

As in the case of the first embodiment, the receiving roller 30 may be equipped with an urging means for urging the receiving roller 30 towards the photosensitive belt 10. FIG.9 shows the receiving roller 30 which is equipped with an urging means 100 which includes a spring 100*a* having a first end fixed to the photosensitive body unit 34 and a second end fixed to a bearing 90 which supports a rotary shaft 30*a* of the receiving roller 30. The spring 100*a* is loaded in a compressed state so that the receiving roller 30 is pushed against the photosensitive belt 10.

Therefore, according to the second embodiment, it is possible to reduce the stress on the photosensitive body because the transfer roller does not push against the photosensitive body when no print operation is carried out. In addition, it is possible to extend the serviceable life of the photosensitive body and prevent the peripheral surface of the transfer roller from becoming deformed with age. The photosensitive body is also prevented from being damaged by the tip end of the guide plate because the tip end of the guide plate is moved away from the photosensitive body when no print operation is carried out. In other words, the guide plate assumes the position close to the photosensitive body in order to guide the recording medium only during the print operation.

Further, the present invention is not limited to these embodiments, but various variations and modifications may be made without departing from the scope of the present invention.

What is claimed is:

1. An image forming apparatus which forms an image on a recording medium by electrophotography during a print operation, said image forming apparatus comprising:

a plurality of support rollers including at least one drive roller;

a photosensitive belt which is fit around said support rollers to form an endless loop, said photosensitive belt having a photosensitive outer surface and an inner surface which is driven by said drive roller so that said photosensitive belt circulates in one direction;

first means for forming an electrostatic image on the outer surface of said photosensitive belt;

second means for developing the electrostatic image on the outer surface of said photosensitive belt into a toner image;

a transfer roller which is located outside the endless loop of said photosensitive belt, said transfer roller alone making contact with the outer surface of said photosensitive belt for a first angular range and bending the photosensitive belt towards the inner side of the endless loop;

third means for supplying a recording medium between said photosensitive belt and said transfer roller so that said transfer roller transfers the toner image on the outer surface of said photosensitive belt onto the recording medium; and a receiving roller which is located inside the endless loop of said photosensitive belt, said receiving roller making contact with the inner surface of said photosensitive belt so that said transfer roller makes contact with the outer surface of said photosensitive belt for a second angular range which is greater than the first angular range through cooperation of said transfer roller and said receiving roller.

2. The image forming apparatus as claimed in claim 1, wherein at least said support rollers, said photosensitive belt and said receiving roller form a photosensitive body unit which is replaceable.

3. The image forming apparatus as claimed in claim 2, which further comprises a first body part for supporting at least said photosensitive body unit, and a second body part for supporting at least said first through third means and said transfer roller, said first body part being provided on said second body part pivottable between open and closed positions, said transfer roller making contact with the outer surface of said photosensitive belt in the closed position of said first body part, said photosensitive belt being released from contact with said transfer roller in the open position of said first body part so that said photosensitive body unit is removable from said first body part.

4. The image forming apparatus as claimed in claim 1, which further comprises a power source which is accommodated within a power source unit, said transfer roller being integrated on said power source unit.

5. The image forming apparatus as claimed in claim 1, wherein said transfer roller constantly makes contact with the outer surface of said photosensitive belt.

6. The image forming apparatus as claimed in claim 1, which further comprises fourth means for urging said receiving roller against the inner surface of said photosensitive belt.

7. The image forming apparatus as claimed in claim 1, wherein said receiving roller makes contact with the inner surface of said photosensitive belt only when said transfer roller makes contact with the outer surface of said photosensitive belt.

8. The image forming apparatus as claimed in claim 1, which further comprises fourth means for urging said transfer roller against the outer surface of said photosensitive belt only during the print operation.

9. The image forming apparatus as claimed in claim 8, which further comprises guide means for guiding the recording medium between said photosensitive belt and said transfer roller in a guiding position located in a vicinity of said photosensitive belt during the print operation, said guide means receding from said guiding position away from said photosensitive belt during an operation of the image forming apparatus other than the print operation.

10. The image forming apparatus as claimed in claim 8, wherein at least said support rollers, said photosensitive belt and said receiving roller form a photosensitive body unit which is replaceable.

11. The image forming apparatus as claimed in claim 10, which further comprises a first body part for supporting at least said photosensitive body unit, and a second body part for supporting at least said first through third means and said transfer roller, said first body part being provided on said second body part pivottable between open and closed positions, said transfer roller making contact with the outer surface of said photosensitive belt in the closed position of said first body part, said photosensitive belt being released from contact with said transfer roller in the open position of said first body part so that said photosensitive body unit is removable from said first body part.

12. The image forming apparatus as claimed in claim 8, which further comprises a power source which is accommodated within a power source unit, said transfer roller being integrated on said power source unit.

13. The image forming apparatus as claimed in claim 8, which further comprises fourth means for urging said receiving roller against the inner surface of said photosensitive belt.

14. The image forming apparatus as claimed in claim 8, wherein said receiving roller makes contact with the inner surface of said photosensitive belt only when said transfer roller makes contact with the outer surface of said photosensitive belt.

* * * * *